US011414856B2

(12) United States Patent
Wu

(10) Patent No.: US 11,414,856 B2
(45) Date of Patent: Aug. 16, 2022

(54) BUILDING DEFORMATION JOINT WATERPROOFING SYSTEM WITH BONDING-TYPE BUILT-IN WATER STOP STRUCTURE, AND METHOD BASED THEREON

(71) Applicant: Zhaosheng Wu, Shenzhen (CN)

(72) Inventor: Zhaosheng Wu, Shenzhen (CN)

( * ) Notice: Subject to any disclaimer, the term of this patent is extended or adjusted under 35 U.S.C. 154(b) by 0 days.

(21) Appl. No.: 17/478,452

(22) Filed: Sep. 17, 2021

(65) Prior Publication Data

US 2022/0098800 A1 Mar. 31, 2022

(30) Foreign Application Priority Data

Sep. 30, 2020 (CN) ..... 202011064859.0

(51) Int. Cl.
*E01C 11/10* (2006.01)
*E04B 1/68* (2006.01)
*E01C 11/06* (2006.01)

(52) U.S. Cl.
CPC ..... *E04B 1/6807* (2013.01); *E04B 1/6803* (2013.01)

(58) Field of Classification Search
CPC ..... E04B 1/6803; E04B 1/6807; E01C 11/10; E01C 11/06; F16B 1/0014
USPC ..... 52/396.02, 396.03; 403/28
See application file for complete search history.

(56) References Cited

U.S. PATENT DOCUMENTS 3,814,530 A * 6/1974 Neff ..... E01D 19/06 404/74
4,076,440 A * 2/1978 Bertschmann ..... E01D 19/062 404/69
4,157,271 A * 6/1979 Moore ..... E04B 1/6803 52/287.1
4,546,024 A * 10/1985 Brown ..... E04F 15/02016 428/44
4,793,162 A * 12/1988 Emmons ..... E02B 3/16 404/69
5,282,693 A * 2/1994 Daily, Jr. ..... E01C 11/106 404/47

(Continued)

FOREIGN PATENT DOCUMENTS

AT 516814 A1 * 8/2016 ..... E04B 1/6803
DE 29710861 U1 * 11/1997 ..... E04B 1/6803

(Continued)

*Primary Examiner* — Brian D Mattei
*Assistant Examiner* — Joseph J. Sadlon
(74) *Attorney, Agent, or Firm* — Li & Cai Intellectual Property (USA) Office

(57) ABSTRACT

A building deformation joint waterproofing system with a bonding-type built-in water stop structure and a method based thereon are provided, which relate to the technical field of building waterproof structures. The system includes: a concrete structure, on which a building deformation joint is disposed; a water stop structure, which is elastic or stretchable, and disposed in the building deformation joint; and a first bonding layer, disposed between the water stop structure and an inner wall of the building deformation joint. The waterproofing system using the foregoing technical solution bonds the water stop structure to the building deformation joint with an adhesive to form a seamless waterproof construction, thus greatly improving the waterproof ability of the building deformation joint.

11 Claims, 17 Drawing Sheets

(56) References Cited

U.S. PATENT DOCUMENTS

| | | | | | |
|---|---|---|---|---|---|
| 5,575,126 | A * | 11/1996 | Attaway | E04B 1/6804 | 52/396.02 |
| 6,151,856 | A * | 11/2000 | Shimonohara | F16B 19/002 | 52/426 |
| 6,751,918 | B2 * | 6/2004 | Jesko | E01D 19/06 | 52/459 |
| 7,143,560 | B2 * | 12/2006 | Jesko | E01D 19/06 | 14/67 |
| 7,634,883 | B1 * | 12/2009 | Larson | E04F 13/06 | 52/573.1 |
| 8,341,908 | B1 * | 1/2013 | Hensley | E04B 1/66 | 52/396.01 |
| 8,887,463 | B2 * | 11/2014 | Derrigan | E02D 17/10 | 52/573.1 |
| 9,032,688 | B2 * | 5/2015 | Summy | E04B 1/665 | 52/60 |
| 9,175,474 | B2 * | 11/2015 | May | F16B 5/01 | |
| 10,851,542 | B2 * | 12/2020 | Hensley | E04B 1/6812 | |

FOREIGN PATENT DOCUMENTS

| | | | | | |
|---|---|---|---|---|---|
| DE | 202013104303 | U1 * | 2/2014 | B32B 5/024 | |
| EP | 0082490 | A2 * | 6/1983 | B32B 5/024 | |
| FR | 1440022 | A * | 5/1966 | E04B 1/6803 | |
| KR | 101455586 | B1 * | 10/2014 | E04B 1/6803 | |

* cited by examiner

A

B

BUILDING DEFORMATION JOINT WATERPROOFING SYSTEM WITH BONDING-TYPE BUILT-IN WATER STOP STRUCTURE, AND METHOD BASED THEREON

FIELD OF THE DISCLOSURE

The present disclosure relates to the technical filed of building waterproof structures, and more particularly to a building deformation joint waterproofing system with a bonding-type built-in water stop structure, and a method based thereon.

BACKGROUND OF THE DISCLOSURE

The "deformation joint" is the general term for an expansion joint, a settlement joint, and a seismic joint. Buildings are often deformed due to external factors, leading to cracking or even damage. In view of this situation, the deformation joints are reserved as construction joints. The national standard GB50108 "Technical Code for Waterproofing of Underground Works" has clear provisions for the waterproofing construction of deformation joints in underground engineering, and it is mandatorily stipulated that the buried water stop is a waterproof measure that must be adopted in the deformation joint. The water stop, coupled with waterproof measures for front and back water surfaces, forms a deformation joint waterproofing system. Such a practice has been implemented in our country for more than half a century, and is also a common practice internationally.

As the most difficult waterproof problem in detail construction, waterproofing for the deformation joints is realized by closely attaching the water stop to the concrete in the prior art. However, such a waterproofing solution has a big problem that there are moving gaps between the water stop and the concrete. Under the external pressure, water enters the interior through the gaps between the rubber-plastic water stop and the concrete, resulting in a low success rate of a building deformation joint waterproofing project. Thus, it is said that "Nine out of ten seams leak". Moreover, once the building deformation joint waterproofing project is leaked, maintenance is rather difficult and the project cannot be fully repaired. Therefore, it is in urgent need to develop a stable and reliable building deformation joint waterproofing system which has a good waterproof effect and is easy in maintenance.

SUMMARY OF THE DISCLOSURE

In view of the shortcomings and deficiencies in the prior art, the present disclosure aims to provide a building deformation joint waterproofing system with a bonding-type built-in water stop structure, which bonds the water stop structure to the two inner wall sides of a building deformation joint with an adhesive to form a seamless waterproof construction, thus greatly improving the waterproof ability of the building deformation joint. Moreover, the system designs a protection structure on a concrete structure, so that the building deformation joint can resist a high water pressure and further can prevent foreign matters from entering the water stop structure, thus having the advantages of a stable waterproof structure, a good waterproof effect, a wide range of application, strong waterproof reliability, a simple structure, easy implementation and operation, easy maintenance, and a long service life.

To achieve the foregoing objective, the present disclosure adopts the following technical solutions:

A building deformation joint waterproofing system with a bonding-type built-in water stop structure is provided, which includes: a concrete structure, on which a building deformation joint is disposed; a water stop structure, which is elastic or stretchable, and disposed in the building deformation joint; and a first bonding layer, disposed between the water stop structure and an inner wall of the building deformation joint.

Preferably, the water stop structure includes: an elastic supporter; and a high polymer roll material which is elastic and disposed in the supporter, where during bonding between the water stop structure and the inner sidewalls of the deformation joint, the water stop structure is pressed against the inner sidewalls of the building deformation joint under the elastic effect of the supporter and the high polymer roll material.

Preferably, the high polymer roll material has an M-shaped or W-shaped cross section.

Preferably, at least the face close to the concrete structure among all faces of the high polymer roll material is designed into a concave and convex face, and the concave and convex face can enhance the strength of connection with the first bonding layer.

Preferably, mutually close sides on the high polymer roll materials of a plurality of adjacent water stop structures are all provided with protruding parts; and a connector which matches the shape of the cross section of the high polymer roll material is fixedly connected to wide surfaces of the protruding parts of the multiple high polymer roll materials, so as to realize connection between two adjacent water stop structures.

Preferably, the connector is connected to the protruding parts of the multiple high polymer roll materials by means of sweat soldering.

Preferably, the connector and the protruding parts of the multiple high polymer roll materials are connected via a second bonding layer.

Preferably, the connector is cross-shaped or T-shaped, or a right-angle shape.

Preferably, the supporter is made from memory foam.

Preferably, the two sidewalls of the building deformation joint on the concrete structure are both provided with recesses; and during bonding between the water stop structure and the building deformation joint, the recesses are filled with an adhesive, and the adhesive is integrally formed with the first bonding layer to serve as snags of the first bonding layer.

Preferably, the building deformation joint waterproofing system further includes: a protection structure; and the protection structure is disposed on an outer wall of the concrete structure, located at the two sides of the building deformation joint, and configured to resist the water pressure and protect the water stop structure.

Preferably, the concrete structure is provided with a fastening hole; and the protection structure includes: a high polymer roll material isolation layer, adhering to the sidewall of the concrete structure; a protection layer, adhering to a side of the high polymer roll material isolation layer away from the concrete structure; and a fastener, passing through the protection layer and the high polymer roll material isolation layer successively to be engaged with the fastening hole.

Preferably, the concrete structure is provided with a groove for accommodating the protection structure, the groove is filled with a concrete layer, and a sealing layer is disposed between sidewalls of the groove and the concrete layer.

Preferably, the protection layer is a steel plate and has a thickness of 8 mm.

The present disclosure achieves the following beneficial effects by using the foregoing technical solution:

1. The water stop structure and the building deformation joint are bonded with an adhesive, to form a seamless waterproof construction, thus greatly improving the waterproof ability and reliability of the building deformation joint and further facilitating maintenance. The maintenance and refurbishment can be performed after debonding with hot wind.

2. Transverse recesses are made on the sidewalls of the building deformation joint, and are filled with the adhesive. The adhesive in the recesses is integrated with the first bonding layer after curing and enables the first bonding layer to be embedded in the concrete structure, thus improving the stability and reliability of the waterproof structure.

3. The protection structure is disposed on the concrete structure. On one hand, the protection layer on the protection structure is configured to resist the water pressure, thus greatly improving the resistance of the waterproofing system to the water pressure and further widening the scope of application of the waterproofing system. On the other hand, the design of the high polymer roll material isolation layer separates the exterior space from the interior space of the building deformation joint, thus preventing entering of foreign matters and prolonging the service life of the waterproofing system.

4. Joints between the multiple high polymer roll materials are easily damaged in a connection manner in the prior art, significantly reducing the tolerance of the water stop structure to the water pressure; and a remedy (Drainage, instead of waterproofing, is adopted, and is implemented in the underground project) to this problem further causes damage to the concrete. Thus, the present disclosure adopts sweat soldering or bonding to connect the multiple water stop structures, which solves the foregoing problems in the prior art; and further, achieves high strength at the connecting ends and is able to tolerate a large degree of deformation, thus being more applicable to the underground project.

In view of the shortcomings and deficiencies in the prior art, the second objective of the present disclosure is to provide a method which is configured to construct the foregoing waterproofing system; and the method has the advantages of a simple construction process, easy operation, little interference from the environment, and few construction procedures.

To achieve the foregoing objective, the present disclosure adopts the following technical solution: A method is provided, which is used for building waterproofing, where the method is based on the above-described building deformation joint waterproofing system and includes the following steps:

S11: building the concrete structure and pre-mounting a filling plate;

S12: cutting recesses on one side of the concrete structure by using a diamond saw blade, and using a measuring tool to enable the recesses to be distributed on the sidewalls of the building deformation joint at equal intervals and to ensure the recesses to have identical sizes;

S13: removing part of the filling plate at the end of the building deformation joint, stuffing the water stop structure into the building deformation joint, and pressing one side of the water stop structure; and coating the inner wall of the building deformation joint with an adhesive and further coating the other side of the water stop structure with the adhesive in the same manner;

S14: under the elastic effect of the supporter and the high polymer roll material 220, the water stop structure being tightly pressed against the inner wall of the building deformation joint, till the water stop structure is bonded to the inner wall of the building deformation joint, to form the first bonding layer;

S15: filling the recesses with the adhesive to make the adhesive adhere to the first bonding layer, till the adhesive in the recesses is cured to form snags of the first bonding layer which are embedded in the concrete structure;

S16: checking the first bonding layer and the snags and adding the adhesive to missed areas;

S17: making the fastening hole on the concrete structure by using perforating equipment, adhering the high polymer roll material isolation layer to the sidewall of the concrete structure, then adhering the protection layer to the sidewall of the high polymer roll material isolation layer, and finally, passing the fastener through the protection layer and the high polymer roll material isolation layer successively to be engaged with the fastening hole, thus completing building of a top plate and sidewalls in the building deformation joint waterproof structure;

S18: making a groove for accommodating the protection structure on the concrete structure at a position corresponding to the building deformation joint, and repeating steps S12 to S17; and S19: filling the groove with fine aggregate concrete and leaving gaps at the two sides, injecting polysulfide sealing paste into the gaps after solidification of the fine aggregate concrete, and the polysulfide sealing paste solidifying into a sealing member, thus completing building of a bottom plate on the concrete structure in the building deformation joint waterproof structure.

The construction of the building deformation joint waterproofing system by using the foregoing method is conducted after the concrete structure is completely solidified, thus avoiding cross-operation with other types of work and disturbance caused by humid operation. Moreover, this construction method is rather simple and has low requirements on an operator, thus reducing the influence of human factors on the construction quality and further saving the labor cost. In addition, the construction method of the waterproofing system has few procedures and is easily monitored, thus greatly shortening the construction period. The method has the advantages of little interference from the environment, a low labor cost, few construction procedures, a short construction period, and a simple construction process.

In view of the shortcomings and deficiencies in the prior art, the third objective of the present disclosure is to provide a method which is configured to construct the foregoing waterproofing system and aims to set up two waterproof structures respectively on a front water surface and a back water surface. The method has the advantages of a strong waterproof effect, a simple construction process, easy operation, little interference from the environment, and few construction procedures.

To achieve the foregoing objective, the present disclosure adopts the following technical solution: A method is provided, which includes the following steps:

S21: building the concrete structure and pre-mounting a filling plate;

S22: cutting recesses on one side of the concrete structure by using a diamond saw blade, and using a measuring tool to enable the recesses 102 to be distributed on the sidewalls of the building deformation joint at equal intervals and to ensure the recesses to have identical sizes;

S23: removing part of the filling plate at the end of the building deformation joint, stuffing the water stop structure into the building deformation joint, and pressing one side of the water stop structure; and coating the inner wall of the building deformation joint with an adhesive and further coating the other side of the water stop structure with the adhesive in the same manner;

S24: under the elastic effect of the supporter and the high polymer roll material, the water stop structure being tightly pressed against the inner wall of the building deformation joint, till the water stop structure is bonded to the inner wall of the building deformation joint, to form the first bonding layer;

S25: filling the recesses with the adhesive to make the adhesive adhere to the first bonding layer, till the adhesive in the recesses is cured to form snags of the first bonding layer which are embedded in the concrete structure;

S26: checking the first bonding layer and the snags and adding the adhesive to missed areas;

S27: making the fastening hole on the concrete structure by using perforating equipment, adhering the high polymer roll material isolation layer to the sidewall of the concrete structure, then adhering the protection layer to the sidewall of the high polymer roll material isolation layer, and finally, passing the fastener through the protection layer and the high polymer roll material isolation layer successively to be engaged with the fastening hole;

S28: connecting the water stop structures to make a circle, and repeating steps S23 to S27, thus completing building of a top plate and sidewalls on the concrete structure in the building deformation joint waterproof structure at the two sides;

S29: making a groove for accommodating the protection structure on the concrete structure at a position corresponding to the building deformation joint, and repeating steps S22 to S24;

S30: stuffing a filling strip into the building deformation joint, connecting the water stop structures to make a circle, and repeating steps S23 to S27; and S31: filling the groove with fine aggregate concrete and leaving gaps at the two sides, injecting polysulfide sealing paste into the gaps after solidification of the fine aggregate concrete, and the polysulfide sealing paste solidifying into a sealing member, thus completing building of a bottom plate on the concrete structure (100) in the building deformation joint waterproof structure.

Preferably, the step of connecting the water stop structures includes the following sub-steps: removing support portions at the ends of multiple water stop structures to be connected so that the high polymer roll materials partially protrude from the water stop structures, and flattening the protruding parts; and flattening a connector, and overlapping the multiple protruding parts with the connector as required and conducting sweat soldering.

Preferably, the step of connecting the water stop structures includes the following sub-steps: removing support portions at the ends of multiple water stop structures to be connected so that the high polymer roll materials partially protrude from the water stop structures; applying butanone to a bonding surface of the connector, wiping it dry immediately, and applying an adhesive; overlapping protruding parts on the multiple high polymer roll materials with the connector, pressing and fixing them with a mold, and removing the extruded adhesive; and removing the mold after a second bonding layer is formed and reaches preset strength.

BRIEF DESCRIPTION OF THE DRAWINGS

To describe the technical solutions in the embodiments of the present disclosure or in the prior art more clearly, the following briefly introduces the accompanying drawings required for describing the embodiments or the prior art. Apparently, the accompanying drawings in the following description show merely some embodiments of the present disclosure, and those of ordinary skill in the art may still derive other drawings from these accompanying drawings without creative efforts.

Figure 1:
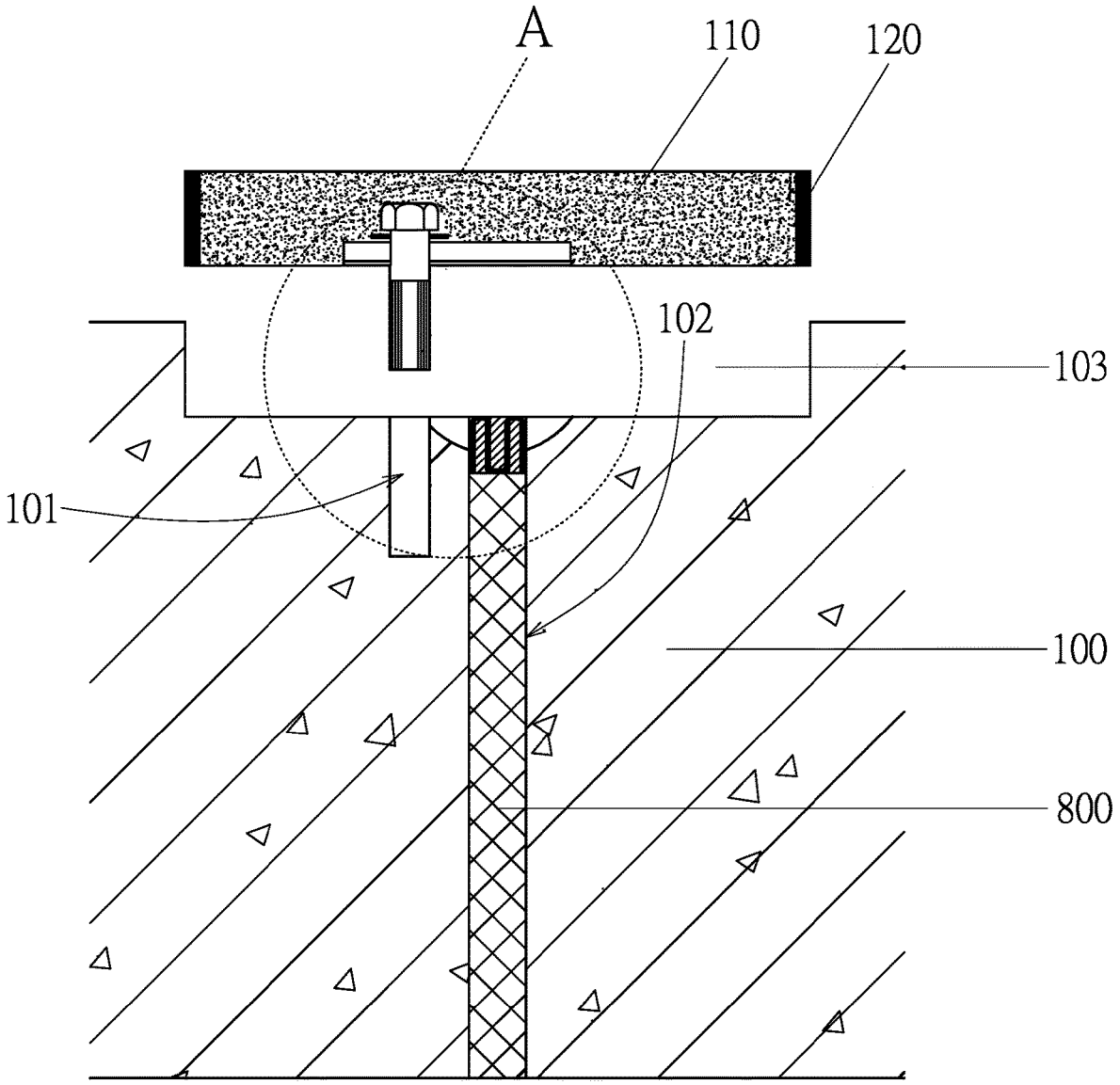
FIG. 1 is a schematic structural diagram of a waterproofing system in this embodiment.

Meanings of numerals: 100. Concrete structure, 101. Fastening hole, 102. Recess, 103. Groove, 110. Concrete layer, 120. Sealing layer, 200. Water stop structure, 201. Deformation groove, 210. Supporter, 220. High polymer roll material, 221. Concave and convex face, 230. Connector, 231. Second bonding layer, 300. First bonding layer, 400. Snag, 500. Protection structure, 510. Protection layer, 520. High polymer roll material isolation layer, 530. Fastener, 600. Mold, 700. Filling strip, 800. Filling plate

DETAILED DESCRIPTION OF THE EXEMPLARY EMBODIMENTS

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be configured to describe various components, signals or the like, which are for distinguishing one component/signal from another one only, and are not intended to, nor should be construed to impose any substantive limitations on the components, signals or the like.

The present disclosure is further described in detail below with reference to the accompanying drawings.

The specific embodiment merely explains the present disclosure, and is not intended to limit the present disclosure. Those skilled in the art can make modifications without any creative contribution to this embodiment as needed after reading the specification. As long as the modifications fall within the scope of the claims of the present disclosure, they are all protected by the patent law.

This embodiment relates to a building deformation joint waterproofing system with a bonding-type built-in water stop structure, which, as shown in FIGS. 1 to 5, includes: a concrete structure 100, a water stop structure 200, and a first bonding layer 300.

Specifically, a building deformation joint is disposed on the concrete structure 100. The water stop structure 200 is elastic and disposed in the building deformation joint. The first bonding layer 300 is disposed between the water stop structure 200 and an inner wall of the building deformation joint.

Figure 2:
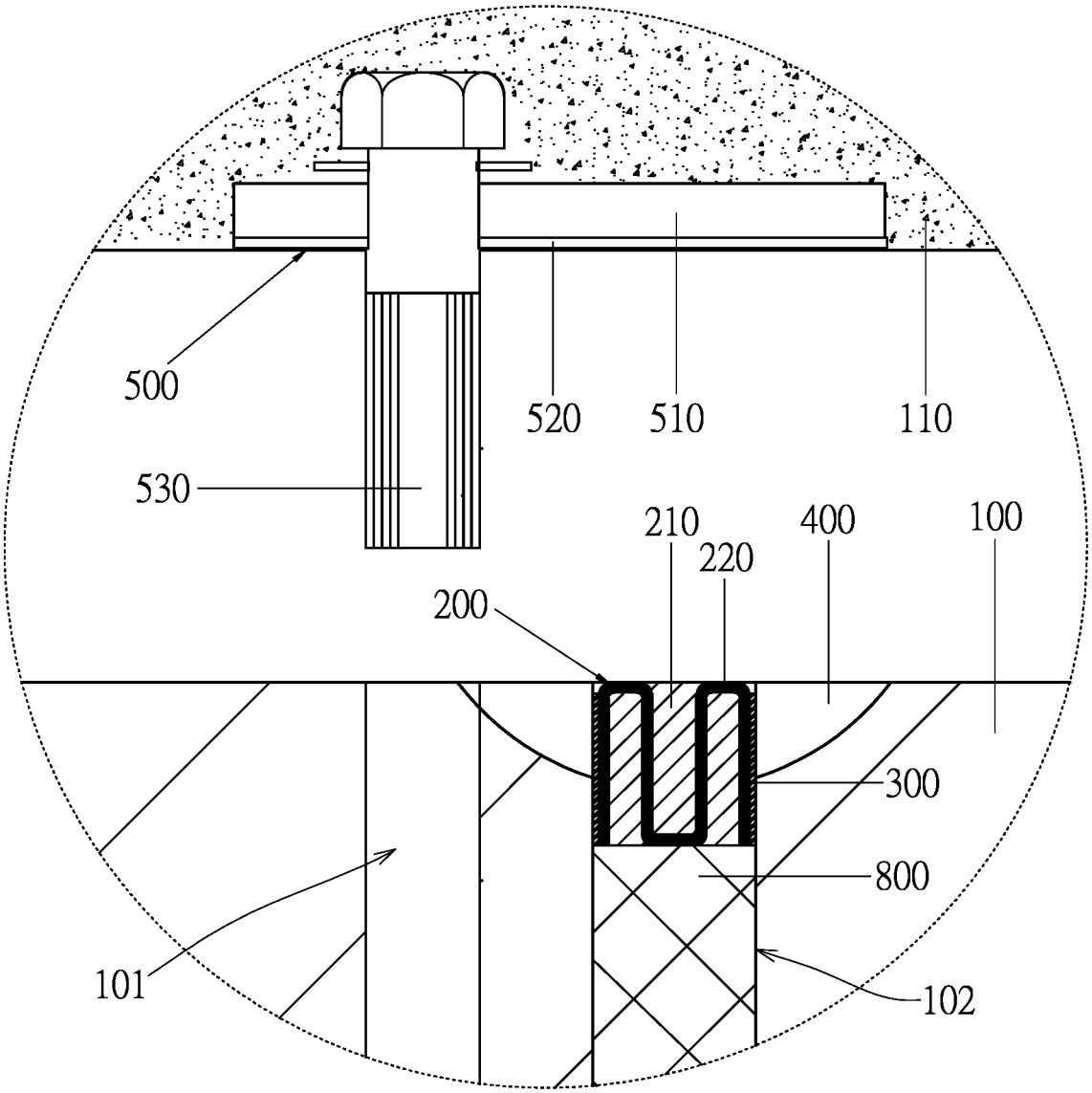
FIG. 2 is an enlarged diagram of a detail A in FIG. 1.
Figure 3:
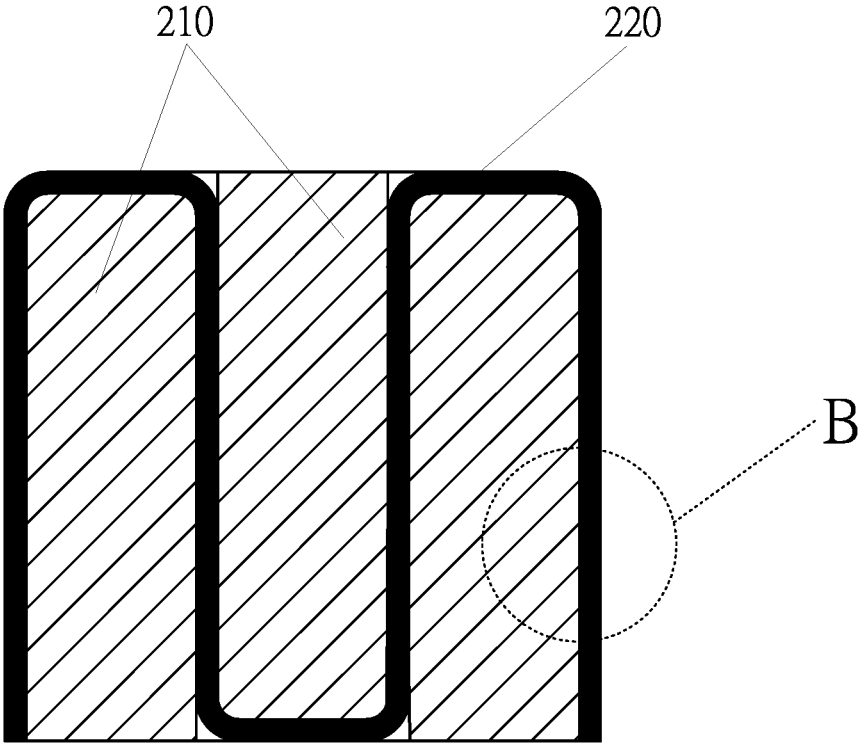
FIG. 3 is a schematic structural diagram of a water stop structure in this embodiment.

Further, as shown in FIGS. 1 and 2, the water stop structure 200 includes a supporter 210, and a high polymer roll material 220 disposed in the supporter 210. The high polymer roll material 220 and the supporter 210 are both elastic. During bonding between the water stop structure 200 and the inner sidewalls of the deformation joint, the water stop structure is pressed against the inner sidewalls of the building deformation joint under the elastic effect of the supporter 210 and the high polymer roll material 220.

Preferably, the high polymer roll material 220 has an M-shaped or W-shaped cross section. The supporter 210 is provided with a deformation groove 201, so that the supporter 210 easily has elastic deformation.

It should be noted that, the M-shaped or W-shaped high polymer roll material 220 has high elasticity due to its structural design. When the high polymer roll material 220 is compressed to contract, the deformation groove 201 is also compressed to contract under the effect of the high polymer roll material 220. In this case, sidewalls of the deformation groove 201 get close or even adhere to each other, and restore to the original shape after the deformation. Such designed deformation groove 201 makes it easy for a filling layer to deform with the deformation of the high polymer roll material 220, thus facilitating installation of the water stop structure 200.

In this embodiment, the high polymer roll material 220 is a PVC roll material with a long service life, the first bonding layer 300 is a modified epoxy adhesive, and the supporter is made from memory foam. On the premise of achieving support to maintain the shape of the high polymer roll material 220, the use of the memory foam as the material of the supporter further achieves good elasticity and makes it unnecessary to use a clamp to hold and deform the water stop structure 200 and stuff it into the building deformation joint, thus simplifying construction steps and reducing the construction difficulty.

Figure 4:
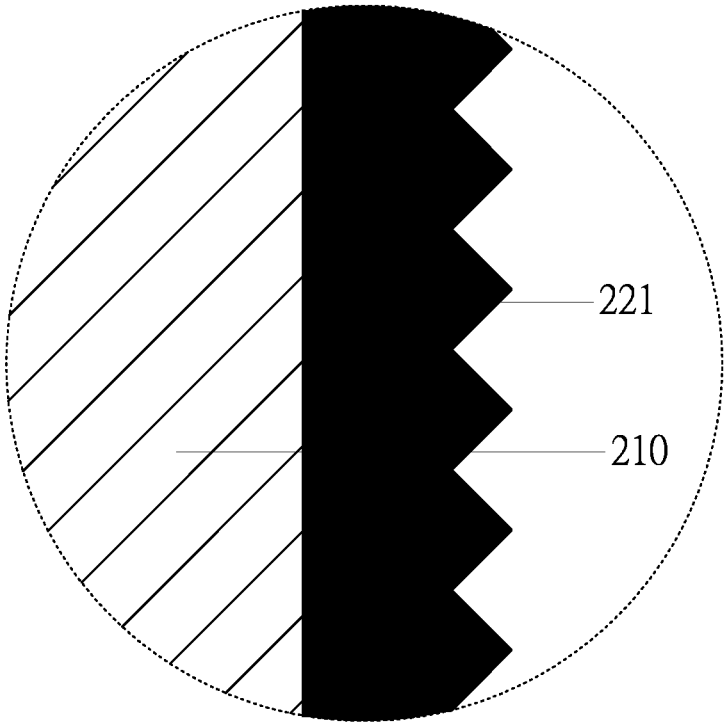
FIG. 4 is an enlarged diagram of a detail B in FIG. 4.
Figure 5:
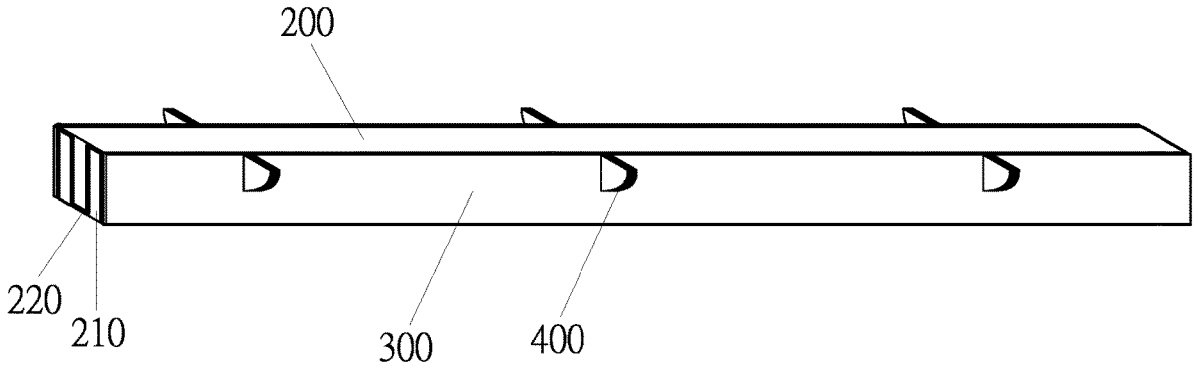
FIG. 5 is a schematic structural diagram of a water stop structure, a first connector, and snags in this embodiment.

As shown in FIG. 4, preferably, at least the face close to the concrete structure 100 among all faces of the high polymer roll material 220 is designed into a concave and convex face 221, and the concave and convex face 221 can enhance the strength of connection with the first bonding layer. The concave and convex face 221 has a serrated or wavy cross section. In this embodiment, the wide surface of the high polymer roll material 220 is uniformly provided with the concave and convex face 221 which has a serrated cross section.

Further, mutually close sides on the high polymer roll materials 220 of a plurality of adjacent water stop structures 200 are provided with protruding parts. A connector which matches the shape of the cross section of the high polymer roll material 220 is uniformly and fixedly connected to wide surfaces of the protruding parts of the multiple high polymer roll materials 220, so as to realize connection between two adjacent water stop structures 200. Preferably, the connector is an M-shaped or W-shaped PVC roll material.

Joints between the multiple high polymer roll materials 220 are easily damaged in a connection manner in the prior art, significantly reducing the tolerance of the water stop structure 200 to the water pressure; and a remedy (Drainage, instead of waterproofing, is adopted, and is implemented in the underground project) to this problem further causes damage to the concrete. Thus, the connection structure of the present disclosure solves the foregoing problems in the prior art; and further, achieves high strength at the connecting ends and is able to tolerate a large degree of deformation, thus being more applicable to the underground project.

Figure 6:
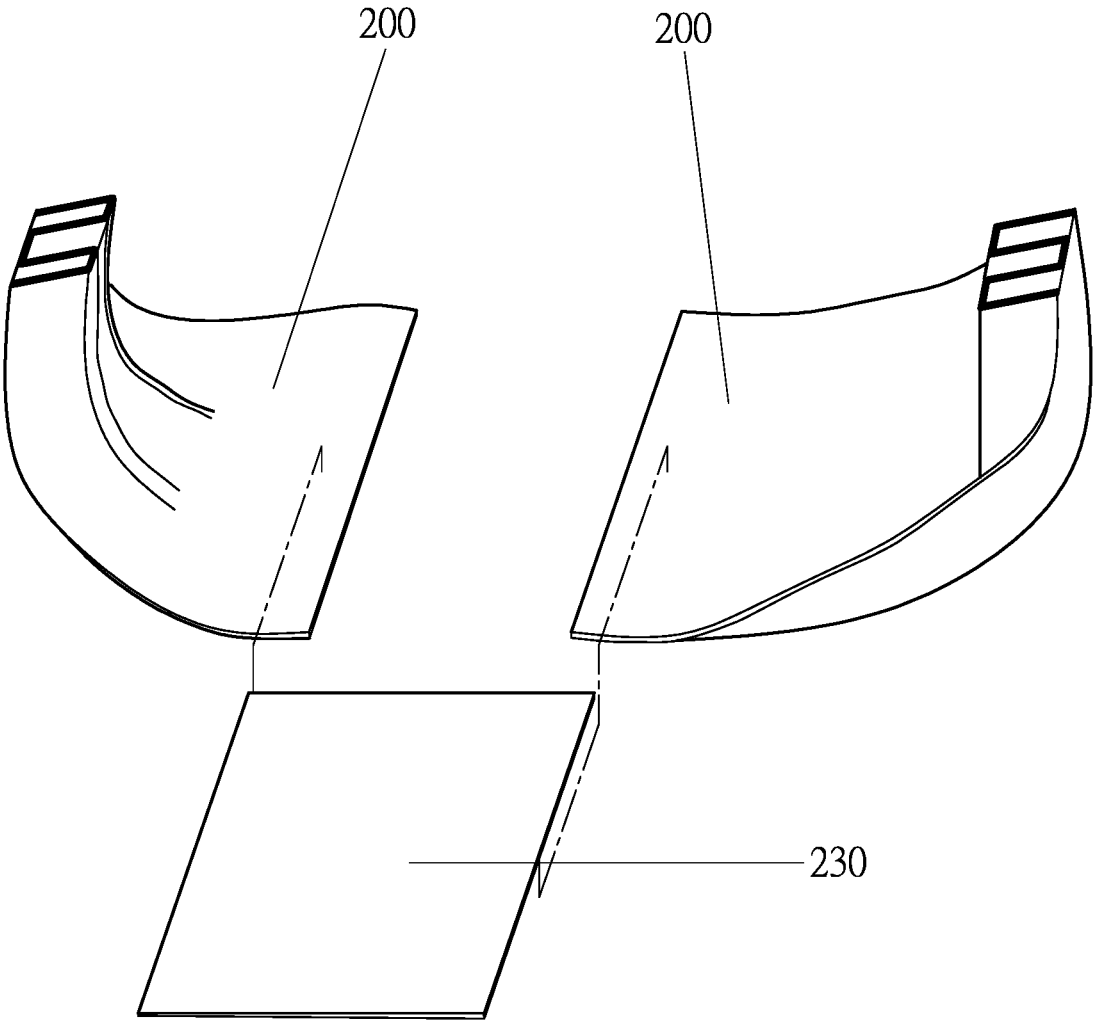
FIG. 6 is a schematic structural diagram showing a process of connection between the water stop structure and the first connector in this embodiment.

In this embodiment, as shown in FIG. 6, the connector is connected to the protruding parts of the multiple high polymer roll materials 220 by means of sweat soldering.

Figure 7:
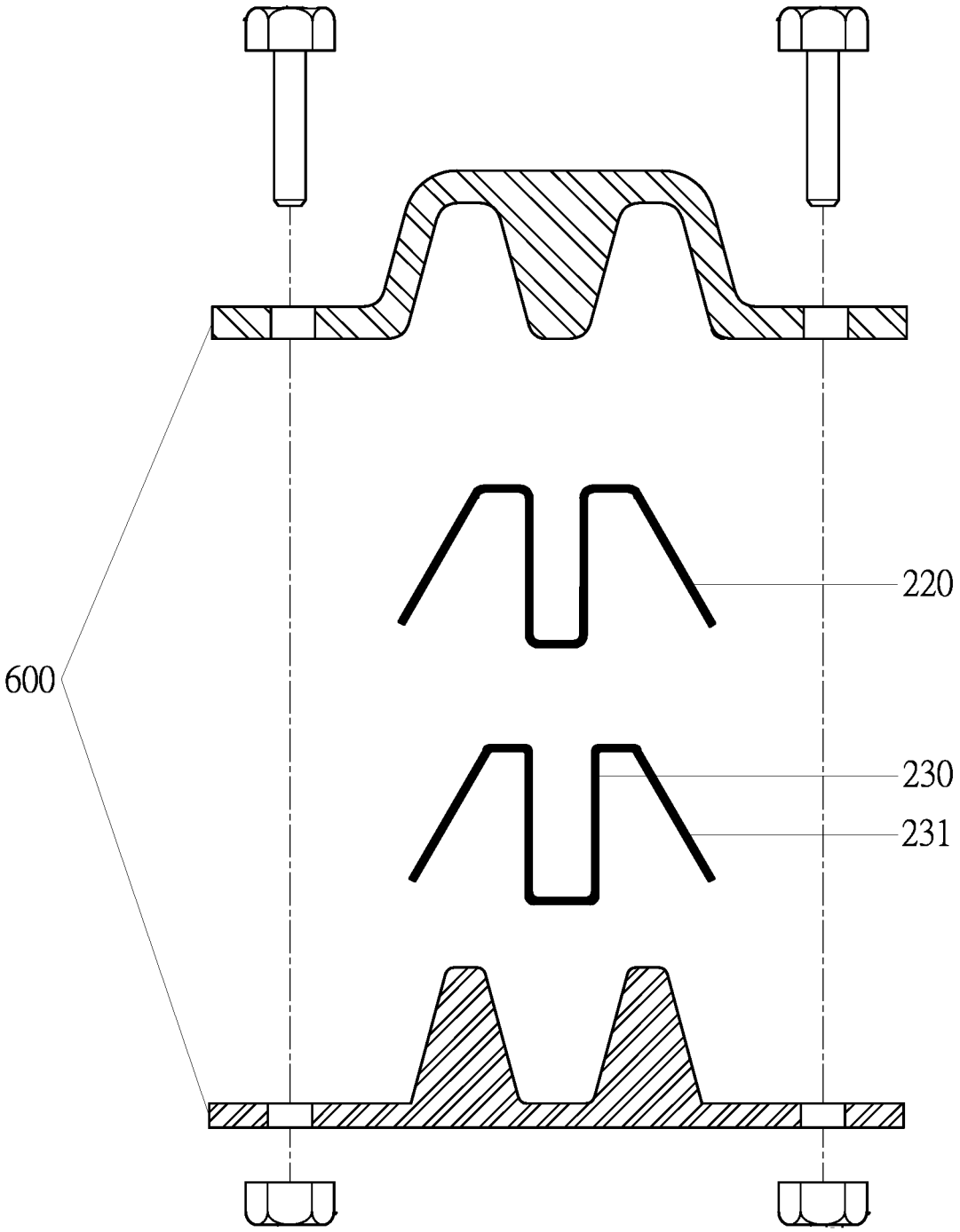
FIG. 7 is a schematic structural diagram showing a process of bonding between the water stop structure and the first connector in this embodiment.
Figure 8A:
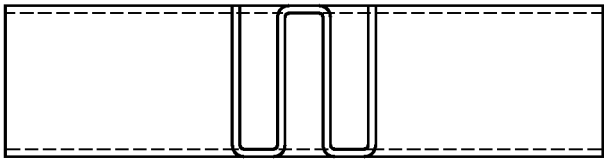
FIG. 8A and FIG. 8B are schematic structural diagrams of a cross-shaped connector in this embodiment.
Figure 8B:
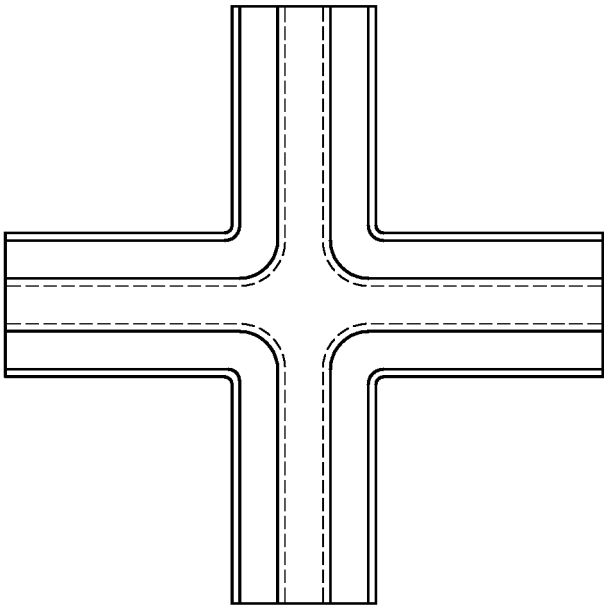
Figure 9A:
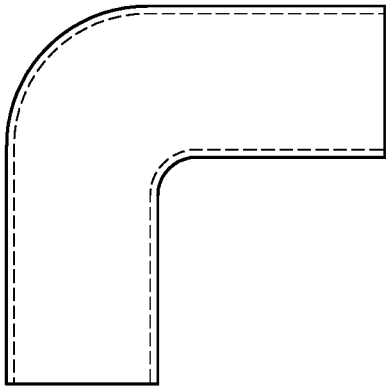
FIG. 9A and FIG. 9B are first schematic structural diagrams of a vertical right-angle connector in this embodiment.
Figure 9B:
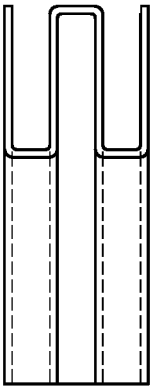
Figure 10A:
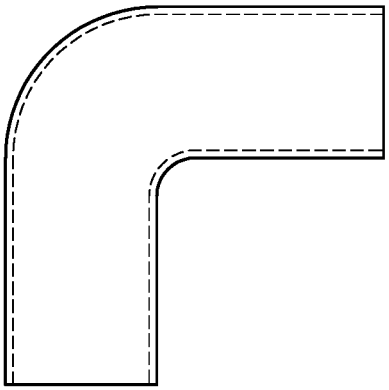
FIG. 10A and FIG. 10B are second schematic structural diagrams of a vertical right-angle connector in this embodiment.
Figure 10B:
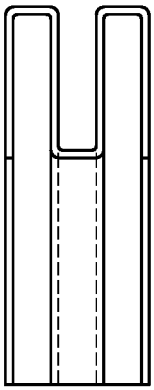
Figure 11A:
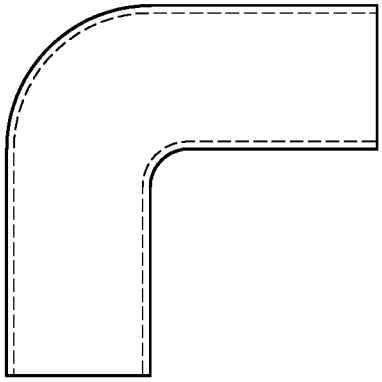
FIG. 11A and FIG. 11B are schematic structural diagrams of a horizontal right-angle connector in this embodiment.
Figure 11B:
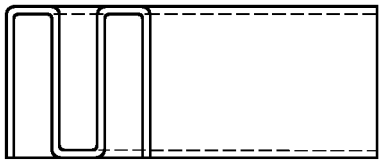
Figure 12A:
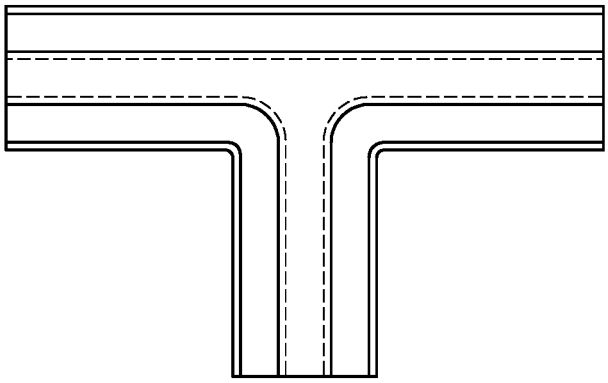
FIG. 12A and FIG. 12B are schematic structural diagrams of a T-shaped connector in this embodiment.
Figure 12B:
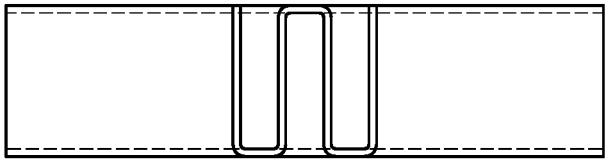

In other embodiments, as shown in FIG. 7, the connector and the protruding parts of the multiple high polymer roll materials 220 are connected via a second bonding layer, where the second bonding layer has a thickness less than or equal to 0.1 mm.

As shown in FIGS. 8 to 12, the connector is cross-shaped or T-shaped, or a right-angle shape.

Preferably, as shown in FIGS. 1 and 2, the two sidewalls of the building deformation joint on the concrete structure 100 are both provided with recesses 102. During bonding between the water stop structure 200 and the building deformation joint, the recesses 102 are filled with an adhesive, and the adhesive in the recesses 102 is integrally formed with the first bonding layer 300 to serve as snags 400 of the first bonding layer 300. After curing, the adhesive in the recesses 102 is integrated with the first bonding layer 300, and the snags 400 are embedded in the concrete structure 100, thus effectively preventing sand from being stripped off the surface of the concrete structure 100 and firmly bonding the water stop structure 200 in the building deformation joint.

Further, as shown in FIG. 2, the building deformation joint waterproofing system further includes a protection structure 500 which is disposed on an outer wall of the concrete structure 100 and is located at the two sides of the building deformation joint. The protection structure 500 is configured to resist the water pressure and protect the water stop structure 200.

Specifically, as shown in FIG. 2, the concrete structure 100 is provided with a fastening hole 101. The protection structure 500 includes a high polymer roll material isolation layer 520, a protection layer 510, and a fastener 530. The high polymer roll material isolation layer 520 adheres to the sidewall of the concrete structure 100, the protection layer 510 adheres to a side of the high polymer roll material isolation layer 520 away from the concrete structure 100, and the fastener 530 passes through the protection layer 510 and the high polymer roll material isolation layer 520 successively and is engaged with the fastening hole 101.

In this embodiment, the protection layer 510 is a steel plate and has a thickness of 8 mm. The fastening hole 101 is a threaded hole, the fastener 530 is an M12 internal expansion bolt, and a gasket is disposed between the bolt and the protection layer 510.

Preferably, the concrete structure 100 is provided with a groove for accommodating the protection structure 500, the groove is filled with a concrete layer, and a sealing layer is disposed between sidewalls of the groove and the concrete layer. Preferably, the sealing layer is formed after solidification of polysulfide sealing paste.

A design principle of this embodiment is roughly described as follows: The water stop structure 200 and the building deformation joint are bonded by using an adhesive, to form a seamless waterproof construction, thus greatly improving the waterproof ability of the building deformation joint. Moreover, the design of the protection structure 500 on the concrete structure 100 enables the building deformation joint to resist a high water pressure and further can prevent foreign matters from entering the water stop structure 200, thus having the advantages of a stable waterproof structure, a good waterproof effect, a wide range of application, strong waterproof reliability, a simple structure, easy implementation and operation, and a long service life.

Figure 13:
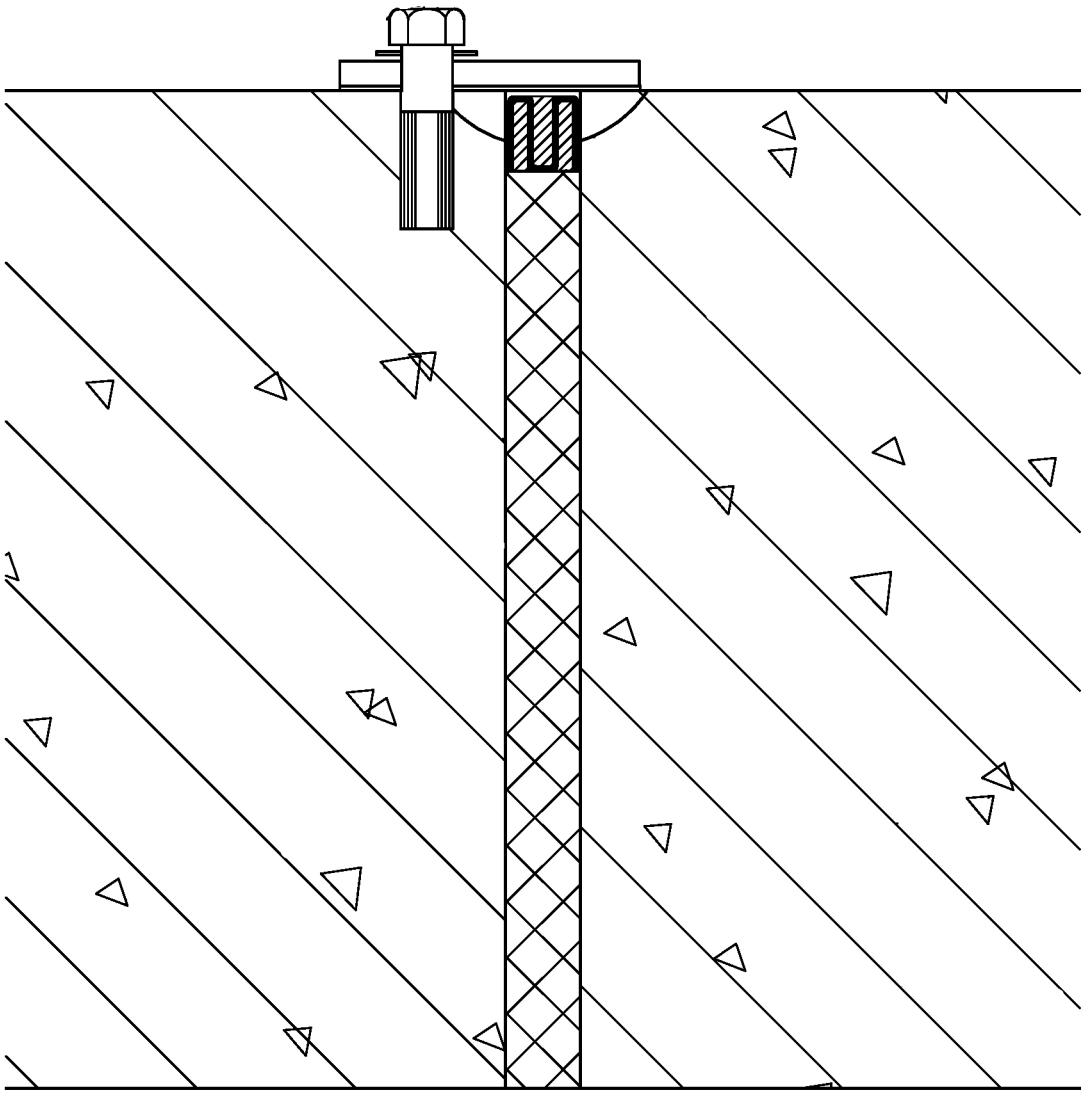
FIG. 13 is a schematic installation diagram of a top plate and sidewalls in a method in this embodiment.
Figure 14:
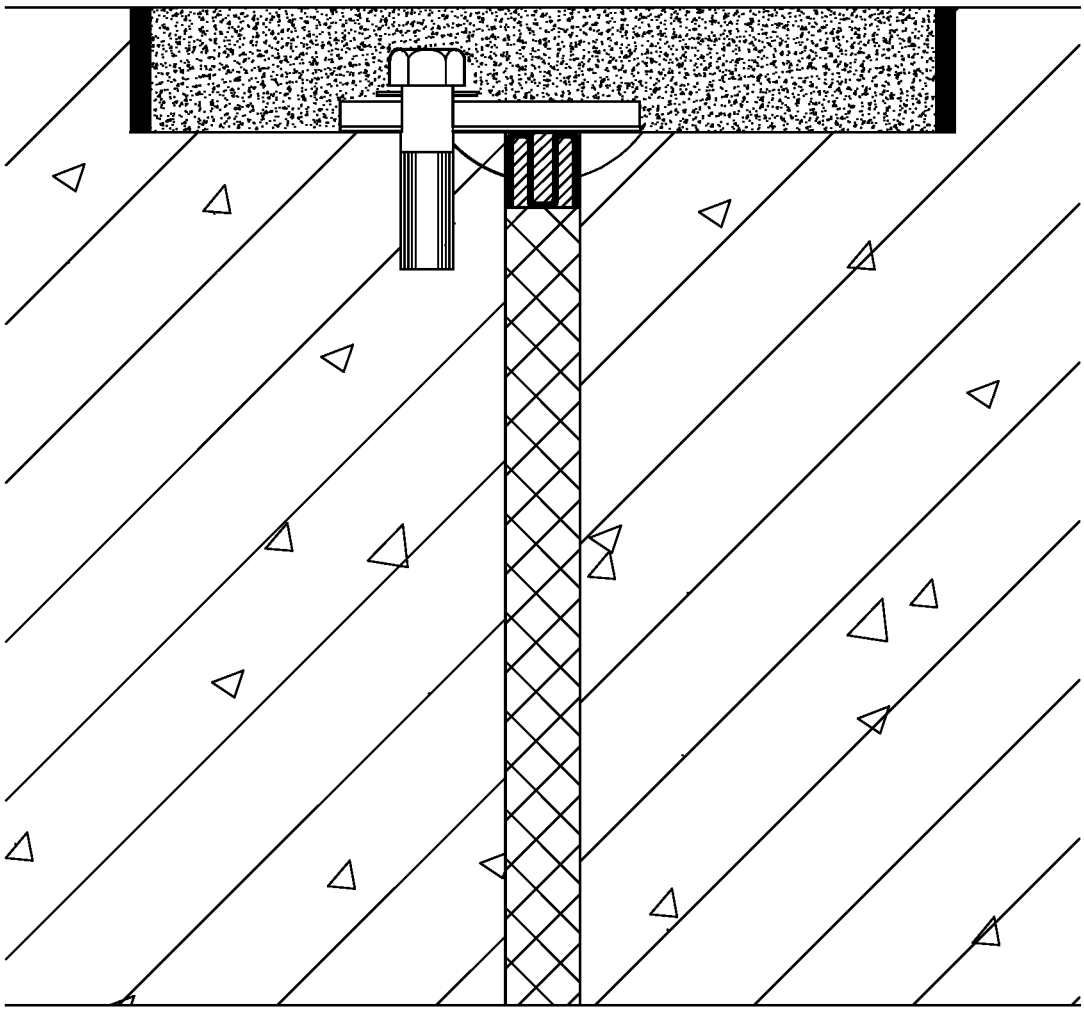
FIG. 14 is a schematic installation diagram of a bottom plate in a method in this embodiment.

Based on the foregoing technical solution, this embodiment further provides a method which is configured to construct the foregoing waterproofing system and aims to install a water stop structure 200. The method has the advantages of a simple construction process, easy operation, little interference from the environment, and few construction procedures. The method includes the following steps:

S11: building the concrete structure 100 and pre-mounting the filling plate; and preparing the water stop structure 200, a diamond saw blade, perforating equipment, a measuring tool, and an adhesive; S12: cutting recesses 102 on one side of the concrete structure 100 by using the diamond saw blade, and using a measuring tool to enable the recesses 102 to be distributed on the sidewalls of the building deformation joint at equal intervals and to ensure the recesses 102 to have identical sizes;

S13: removing part of the filling plate at the end of the building deformation joint, stuffing the water stop structure 200 into the building deformation joint, and pressing one side of the water stop structure 200; and coating the inner wall of the building deformation joint with the adhesive and further coating the other side of the water stop structure 200 with the adhesive in the same manner;

S14: under the elastic effect of the supporter 210 and the high polymer roll material 220, the water stop structure 200 being tightly pressed against the inner wall of the building deformation joint, till the water stop structure 200 is bonded to the inner wall of the building deformation joint, to form the first bonding layer 300;

S15: filling the recesses 102 with the adhesive to make the adhesive adhere to the first bonding layer 300, till the adhesive in the recesses 102 is cured to form snags 400 of the first bonding layer 300 which are embedded in the concrete structure 100;

S16: checking the first bonding layer 300 and the snags 400 and adding the adhesive to missed areas;

S17: making the fastening hole 101 on the concrete structure 100 by using the perforating equipment, adhering an isolation layer of the high polymer roll material 220 to the sidewall of the concrete structure 100, then adhering the protection layer 510 to the sidewall of the isolation layer of the high polymer roll material 220, and finally, passing the fastener 530 through the protection layer 510 and the isolation layer of the high polymer roll material 220 successively to be engaged with the fastening hole 101, as shown in FIG. 13, thus completing building of a top plate and sidewalls in the building deformation joint waterproof structure;

S18: making a groove for accommodating the protection structure 500 on the concrete structure 100 at a position corresponding to the building deformation joint, and repeating steps S12 to S17; and S19: filling the groove with fine aggregate concrete and leaving gaps at the two sides, injecting polysulfide sealing paste into the gaps after solidification of the fine aggregate concrete, and the polysulfide sealing paste solidifying into a sealing member, as shown in FIG. 14, thus completing building of a bottom plate on the concrete structure 100 in the building deformation joint waterproof structure.

The construction of the building deformation joint waterproofing system by using the foregoing method is conducted after the concrete structure 100 is completely solidified, thus avoiding cross-operation with other types of work and disturbance caused by humid operation. Moreover, this construction method is rather simple and has low requirements on an operator, thus reducing the influence of human factors on the construction quality and further saving the labor cost. In addition, the construction method of the waterproofing system has few procedures and is easily monitored, thus greatly shortening the construction period. The method has the advantages of little interference from the environment, a low labor cost, few construction procedures, a short construction period, and a simple construction process.

Figure 15:
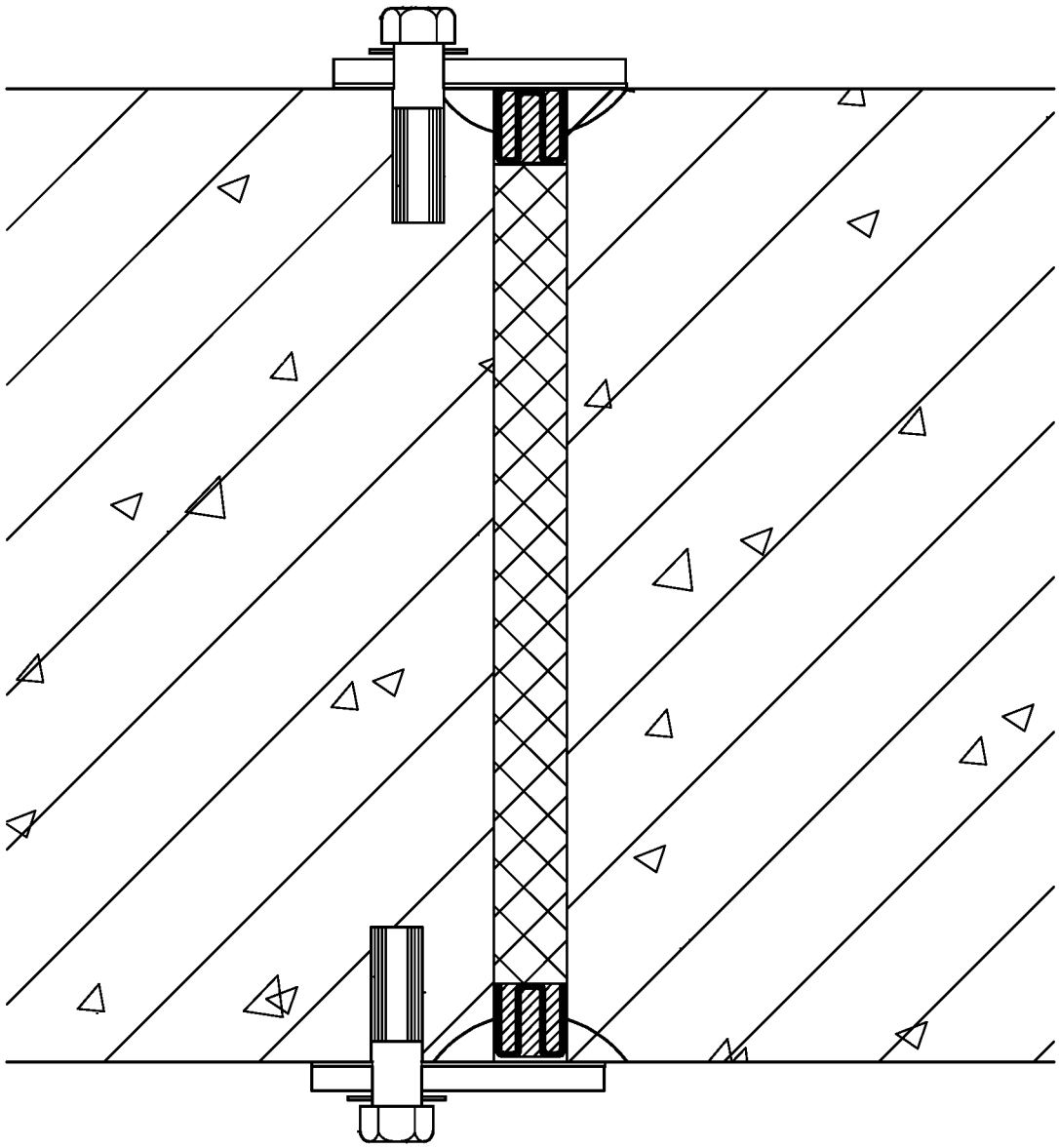
FIG. 15 is a schematic installation diagram of a top plate and sidewalls in another method in this embodiment.
Figure 16:
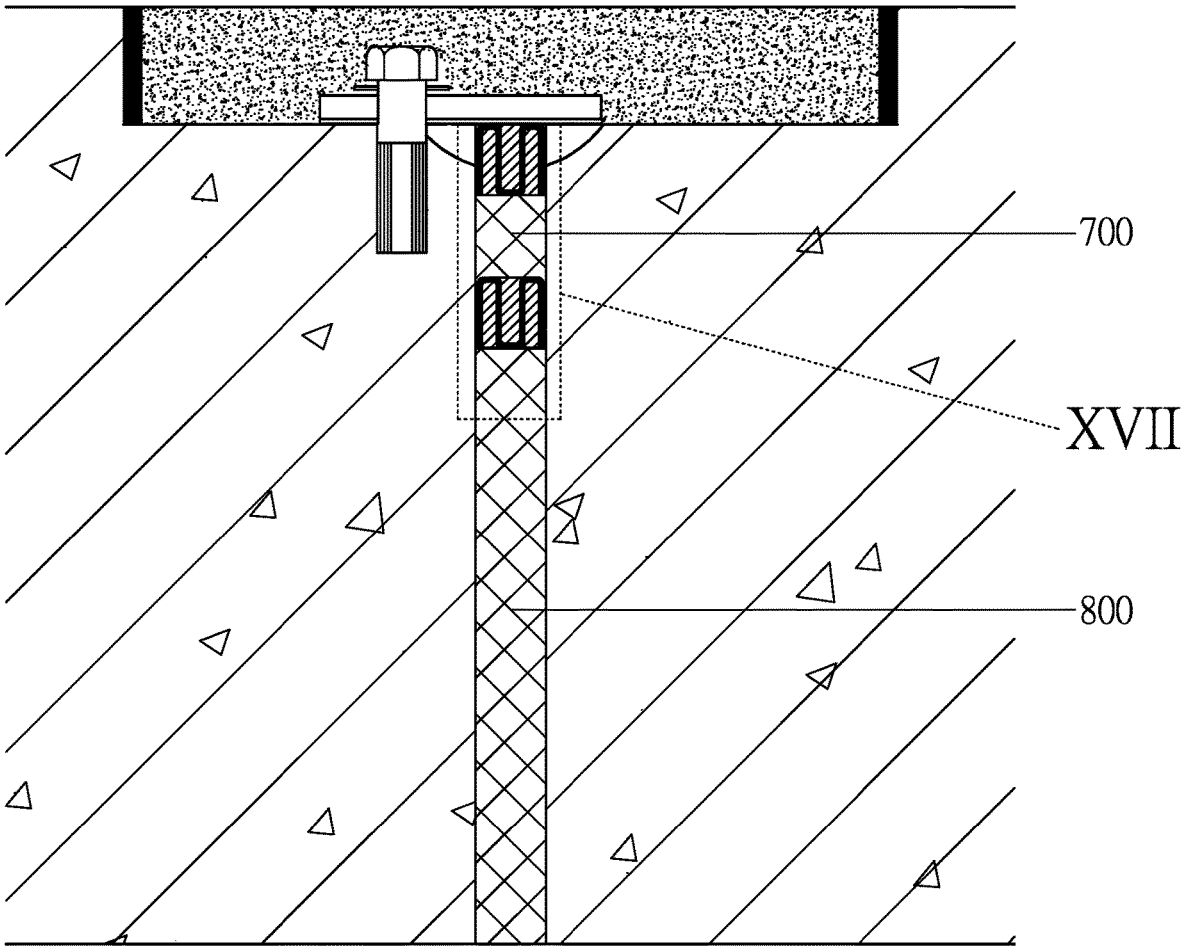
FIG. 16 is a schematic installation diagram of a bottom plate in another method in this embodiment.
Figure 17:
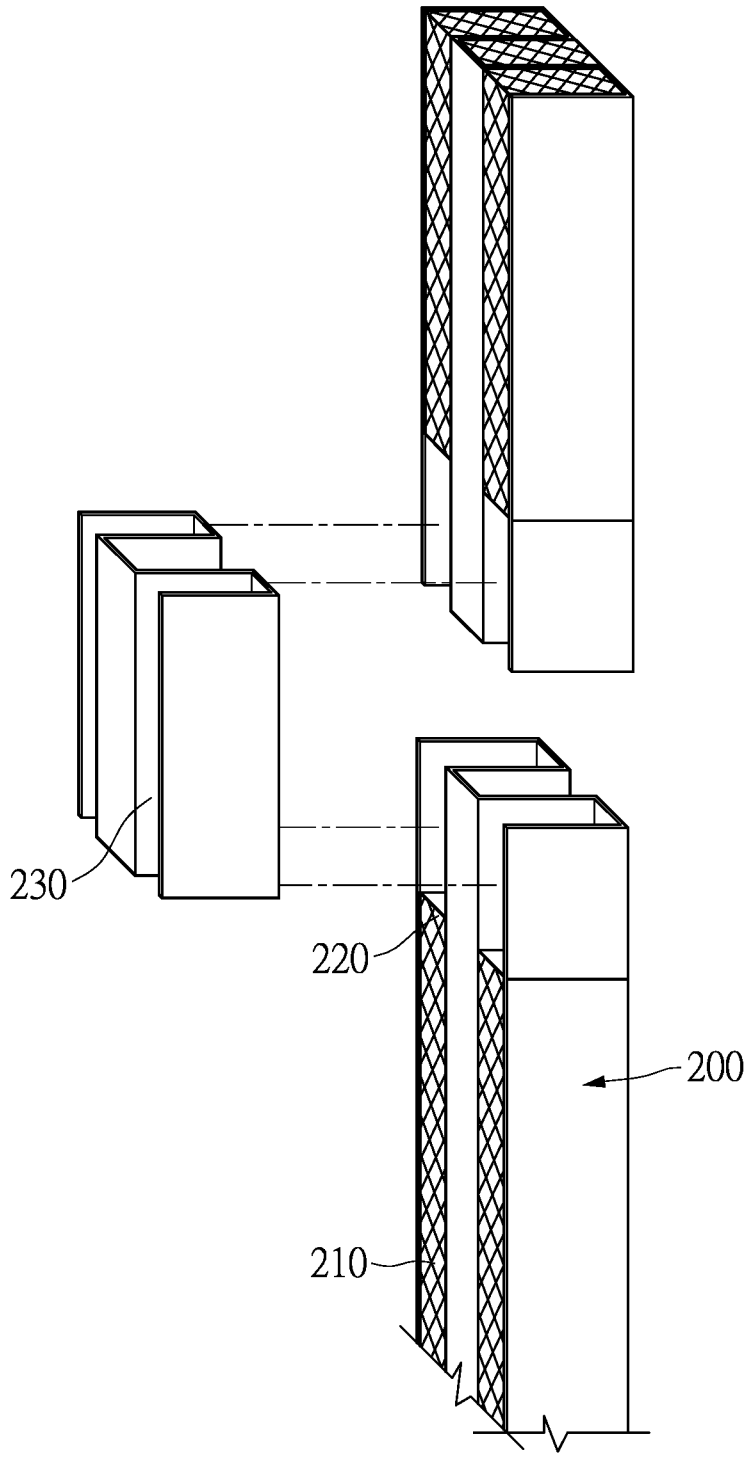
FIG. 17 is an enlarged side view of part XVII of FIG. 16 which a filler plate is removed.

Based on the foregoing technical solution, this embodiment further provides another method which is configured to construct the foregoing waterproofing system and aims to set up two waterproof structures respectively on a front water surface and a back water surface. This method has the advantages of a strong waterproof effect, a simple construction process, easy operation, little interference from the environment, and few construction procedures. As shown in FIGS. 5 to 12 in which the direction of the arrow shows the direction of water pressure, the method includes the following steps:

S21: building the concrete structure 100 and pre-mounting the filling plate 800;

S22: cutting recesses 102 on one side of the concrete structure 100 by using the diamond saw blade, and using a measuring tool to enable the recesses 102 to be distributed on the sidewalls of the building deformation joint at equal intervals and to ensure the recesses 102 to have identical sizes;

S23: removing part of the filling plate 800 at the end of the building deformation joint, stuffing the water stop structure 200 into the building deformation joint, and pressing one side of the water stop structure 200; and coating the inner wall of the building deformation joint with the adhesive and further coating the other side of the water stop structure 200 with the adhesive in the same manner;

S24: under the elastic effect of the supporter 210 and the high polymer roll material 220, the water stop structure 200 being tightly pressed against the inner wall of the building deformation joint, till the water stop structure 200 is bonded to the inner wall of the building deformation joint, to form the first bonding layer 300;

S25: filling the recesses 102 with the adhesive to make the adhesive adhere to the first bonding layer 300, till the adhesive in the recesses 102 is cured to form snags 400 of the first bonding layer 300 which are embedded in the concrete structure 100;

S26: checking the first bonding layer 300 and the snags 400 and adding the adhesive to missed areas;

S27: making the fastening hole 101 on the concrete structure 100 by using the perforating equipment, adhering an isolation layer of the high polymer roll material 220 to the sidewall of the concrete structure 100, then adhering the protection layer 510 to the sidewall of the isolation layer of the high polymer roll material 220, and finally, passing the fastener 530 through the protection layer 510 and the isolation layer of the high polymer roll material 220 successively to be engaged with the fastening hole 101;

S28: connecting the water stop structures 200 to make a circle, and repeating steps S23 to S27, thus completing building of a top plate and sidewalls on the concrete structure 100 in the building deformation joint waterproof structure at the two sides, as shown in FIG. 15;

S29: making a groove for accommodating the protection structure 500 on the concrete structure 100 at a position corresponding to the building deformation joint, and repeating steps S22 to S24;

S30: stuffing a filling strip 700 into the building deformation joint, connecting the water stop structures 200 to make a circle, and repeating steps S23 to S27; and S31: filling the groove with fine aggregate concrete and leaving gaps at the two sides, injecting polysulfide sealing paste into the gaps after solidification of the fine aggregate concrete, and the polysulfide sealing paste solidifying into a sealing member, thus completing building of a bottom plate on the concrete structure 100 in the building deformation joint waterproof structure, as shown in FIG. 16 and FIG. 17.

Further, in this embodiment, the step of connecting the water stop structures 200 includes the following sub-steps: removing support portions at the ends of multiple water stop structures 200 to be connected so that the high polymer roll materials partially protrude from the water stop structures 200, and flattening the protruding parts; and flattening a connector, and overlapping the multiple protruding parts with the connector as required and conducting sweat soldering.

In other embodiments, the step of connecting the water stop structures 200 includes the following sub-steps: removing support portions at the ends of multiple water stop structures 200 to be connected so that the high polymer roll materials 220 partially protrude from the water stop structures 200; applying butanone to a bonding surface of the connector, wiping it dry immediately, and applying an adhesive; overlapping protruding parts on the multiple high polymer roll materials 220 with the connector, pressing and fixing them with a mold 600, and removing the extruded adhesive; and removing the mold 600 after a second bonding layer is formed and reaches preset strength.

It should be noted that, bonding needs to be completed within 4 hours after the bonding surface of the connector is applied and cleaned with butanone. Otherwise, the bonding surface needs to be re-cleaned.

The above merely describes, rather than limiting, the technical solutions of the present disclosure. Other modifications or equivalent substitutions made by persons of ordinary skill in the art to the technical solutions of the present disclosure shall all fall within the scope of claims of the present disclosure as long as they do not depart from the spirit and scope of the technical solutions of the present disclosure.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A building deformation joint waterproofing system with a bonding-type built-in water stop structure, comprising:

a concrete structure on which a building deformation joint is disposed;

a water stop structure which is elastic or stretchable, and disposed in the building deformation joint, wherein the water stop structure comprises:

an elastic supporter; and a high polymer roll material which is elastic and disposed in the supporter, wherein during bonding between the water stop structure and inner walls of the building deformation joint, the water stop structure is pressed against the inner walls of the building deformation joint under an elastic effect of the supporter and the high polymer roll material; and a first bonding layer disposed between the water stop structure and an inner wall of the building deformation joint;

wherein the high polymer roll material has an M-shaped or W-shaped cross section;

wherein the high polymer roll material is a plurality of high polymer roll materials and the plurality of high polymer roll materials form a plurality of adjacent water stop structures having mutually close sides, the plurality of high polymer roll materials are all provided with protruding parts; and a connector which matches a shape of the cross section of the high polymer roll material is fixedly connected to wide surfaces of the protruding parts of the multiple high polymer roll materials, so as to realize connection between two adjacent water stop structures;

wherein two sidewalls of the building deformation joint on the concrete structure are both provided with recesses; and during bonding between the water stop structure and the building deformation joint, the recesses are filled with an adhesive, and the adhesive is integrally formed with the first bonding layer to serve as snags of the first bonding layer;

wherein the building deformation joint waterproofing system further comprises: a protection structure; and the protection structure is disposed on an outer wall of the concrete structure, located at two sides of the building deformation joint, and configured to resist the water pressure and protect the water stop structure;

wherein the concrete structure is provided with a fastening hole; and the protection structure comprises:

a high polymer roll material isolation layer adhering to a sidewall of the concrete structure;

a protection layer adhering to a side of the high polymer roll material isolation layer away from the concrete structure; and a fastener passing through the protection layer and the high polymer roll material isolation layer successively to be engaged with the fastening hole.

2. The building deformation joint waterproofing system with a bonding-type built-in water stop structure according to claim 1, wherein at least one face adjacent to the concrete structure among all faces of the high polymer roll material is designed into a concave and convex face, and the concave and convex face is able to enhance a strength of connection with the first bonding layer.

3. The building deformation joint waterproofing system with a bonding-type built-in water stop structure according to claim 1, wherein the connector is connected to the protruding parts of the multiple high polymer roll materials by means of sweat soldering.

4. The building deformation joint waterproofing system with a bonding-type built-in water stop structure according to claim 1, wherein the connector and the protruding parts of the multiple high polymer roll materials are connected via a second bonding layer.

5. The building deformation joint waterproofing system with a bonding-type built-in water stop structure according to claim 1, wherein the connector is cross-shaped or T-shaped, or a right-angle shape.

6. The building deformation joint waterproofing system with a bonding-type built-in water stop structure according to claim 1, wherein the supporter is made from memory foam.

7. The building deformation joint waterproofing system with a bonding-type built-in water stop structure according to claim 1, wherein the concrete structure is provided with a groove for accommodating the protection structure, the groove is filled with a concrete layer, and a sealing layer is disposed between sidewalls of the groove and the concrete layer.

8. A method for building waterproofing, wherein the method is based on the building deformation joint waterproofing system of claim 7 and comprises the following steps:

step S11 comprises building the concrete structure and pre-mounting a filling plate;

step S12 comprises cutting recesses on one side of the concrete structure by using a diamond saw blade, and using a measuring tool to enable the recesses to be distributed on sidewalls of the building deformation joint at equal intervals and to ensure the recesses to have identical sizes;

step S13 comprises removing part of the filling plate at an end of the building deformation joint, stuffing the water stop structure into the building deformation joint, and pressing one side of the water stop structure; and coating the inner wall of the building deformation joint with an adhesive and further coating the other side of the water stop structure with the adhesive in the same manner;

step S14 comprises under the elastic effect of the supporter and the high polymer roll material, the water stop structure being tightly pressed against the inner wall of the building deformation joint, till the water stop structure is bonded to the inner wall of the building deformation joint, to form the first bonding layer;

step S15 comprises filling the recesses with the adhesive to make the adhesive adhere to the first bonding layer, till the adhesive in the recesses is cured to form snags of the first bonding layer which are embedded within the concrete structure;

step S16 comprises checking the first bonding layer and the snags and adding the adhesive to missed areas;

step S17 comprises making the fastening hole on the concrete structure by using perforating equipment, adhering an isolation layer of the high polymer roll material to the sidewall of the concrete structure, then adhering the protection layer to a sidewall of the isolation layer of the high polymer roll material, and finally, passing the fastener through the protection layer and the isolation layer of the high polymer roll material successively to be engaged with the fastening hole, thus completing building of a top plate and sidewalls in the building deformation joint waterproof structure;

step S18 comprises making a groove for accommodating the protection structure on the concrete structure at a position corresponding to the building deformation joint, and repeating steps S12 to S17; and step S19 comprises filling the groove with fine aggregate concrete and leaving gaps at two sides, injecting polysulfide sealing paste into the gaps after solidification of the fine aggregate concrete, and the polysulfide sealing paste solidifying into a sealing member, thus completing building of a bottom plate on the concrete structure in the building deformation joint waterproof structure.

9. A method for building waterproofing, wherein the method is based on the building deformation joint waterproofing system of claim 7 and comprises the following steps:

step S21 comprises building the concrete structure and pre-mounting a filling plate;

step S22 comprises cutting recesses on one side of the concrete structure) by using a diamond saw blade, and using a measuring tool to enable the recesses to be distributed on sidewalls of the building deformation joint at equal intervals and to ensure the recesses to have identical sizes;

step S23 comprises removing part of the filling plate at an end of the building deformation joint, stuffing the water stop structure into the building deformation joint, and pressing one side of the water stop structure; and coating the inner wall of the building deformation joint with an adhesive and further coating the other side of the water stop structure with the adhesive in the same manner;

step S24 comprises under the elastic effect of the supporter and the high polymer roll material, the water stop structure being tightly pressed against the inner wall of the building deformation joint, till the water stop structure is bonded to the inner wall of the building deformation joint, to form the first bonding layer;

step S25 comprises filling the recesses with the adhesive to make the adhesive adhere to the first bonding layer, till the adhesive in the recesses is cured to form snags of the first bonding layer which are embedded within the concrete structure;

step S26 comprises checking the first bonding layer and the snags and adding the adhesive to missed areas;

step S27 comprises making the fastening hole on the concrete structure by using perforating equipment, adhering an isolation layer of the high polymer roll material to the sidewall of the concrete structure, then adhering the protection layer to a sidewall of the isolation layer of the high polymer roll material, and finally, passing the fastener through the protection layer and the isolation layer of the high polymer roll material successively to be engaged with the fastening hole;

step S28 comprises connecting the water stop structures to make a circle, and repeating steps S23 to S27, thus completing building of a top plate and sidewalls on the concrete structure in the building deformation joint waterproof structure at the two sides;

step S29 comprises making a groove for accommodating the protection structure on the concrete structure at a position corresponding to the building deformation joint, and repeating steps S22 to S24;

step S30 comprises stuffing a filling strip into the building deformation joint, connecting the water stop structures to make a circle, and repeating steps S23 to S27; and step S31 comprises filling the groove with fine aggregate concrete and leaving gaps at two sides, injecting polysulfide sealing paste into the gaps after solidification of the fine aggregate concrete, and the polysulfide sealing paste solidifying into a sealing member, thus completing building of a bottom plate on the concrete structure in the building deformation joint waterproof structure.

10. The method according to claim 9, wherein the step of connecting the water stop structures comprises the following sub-steps:

removing support portions at ends of multiple water stop structures to be connected so that the high polymer roll materials partially protrude from the water stop structures, and flattening the protruding parts; and flattening a connector, and overlapping the multiple protruding parts with the connector as required and conducting sweat soldering.

11. The method according to claim 9, wherein the step of connecting the water stop structures comprises the following sub-steps:

removing support portions at the ends of multiple water stop structures to be connected so that the high polymer roll materials partially protrude from the water stop structures;

applying butanone to a bonding surface of the connector, wiping it dry immediately, and applying an adhesive;

overlapping protruding parts on the multiple high polymer roll materials with the connector, pressing and fixing them with a mold, and removing the extruded adhesive; and removing the mold after a second bonding layer is formed and reaches preset strength.

* * * * *